United States Patent [19]

Bulatovic

[11] 4,246,096

[45] Jan. 20, 1981

[54] FLOTATION PROCESS

[75] Inventor: Srdjan Bulatovic, Peterborough, Canada

[73] Assignee: Falconbridge Copper Limited, Toronto, Canada

[21] Appl. No.: 17,320

[22] Filed: Mar. 5, 1979

[30] Foreign Application Priority Data

Mar. 11, 1978 [GB] United Kingdom ..... 970378

[51] Int. Cl.[3] ..... B03D 1/06

[52] U.S. Cl. ..... 201/167

[58] Field of Search ..... 209/166, 167

[56] References Cited

U.S. PATENT DOCUMENTS

| | | | |
|---|---|---|---|
| 1,142,821 | 6/1915 | Lavers | 209/167 |
| 1,741,028 | 12/1929 | Koenig | 209/167 |
| 2,120,485 | 6/1938 | Clemmer | 209/167 |
| 2,349,637 | 5/1944 | Rockwardt | 209/167 X |
| 2,559,104 | 7/1951 | Arbiter | 209/167 X |

FOREIGN PATENT DOCUMENTS

| | | | |
|---|---|---|---|
| 9508 | of 1914 | Australia | 209/167 |
| 640751 | 5/1962 | Canada | 209/167 |
| 1118112 | 11/1961 | Fed. Rep. of Germany | 209/166 |
| 1150031 | 6/1963 | Fed. Rep. of Germany | 209/167 |
| 152439 | 4/1961 | U.S.S.R. | 209/167 |

OTHER PUBLICATIONS

Chem. Abst., vol. 64, 1966–4668 c.

Fiftieth Anniversary of Froth Flotation, Col. School of Mines, Jul. 1961, Dezincing of Lead Concentrate, pp. 145–161.

*Primary Examiner*—Robert Halper

*Attorney, Agent, or Firm*—Richard J. Hicks; Stanley E. Johnson

[57] ABSTRACT

A method for separating copper sulphides from lead sulphides contained in particulate copper lead sulphide concentrates by a flotation process in which an aqueous alkali metal silicate-alkali metal dichromate reagent solution is added in the flotation step to depress the lead bearing sulphides. The copper lead sulphide concentrate may be obtained from a complex copper-lead-zinc ore, in which case the majority of the zinc is first removed by conventional flotation techniques and the copper lead sulphide concentrate treated with activated carbon prior to addition of the silicate-dichromate reagent solution.

7 Claims, 1 Drawing Figure

FLOTATION PROCESS

Figure 1:
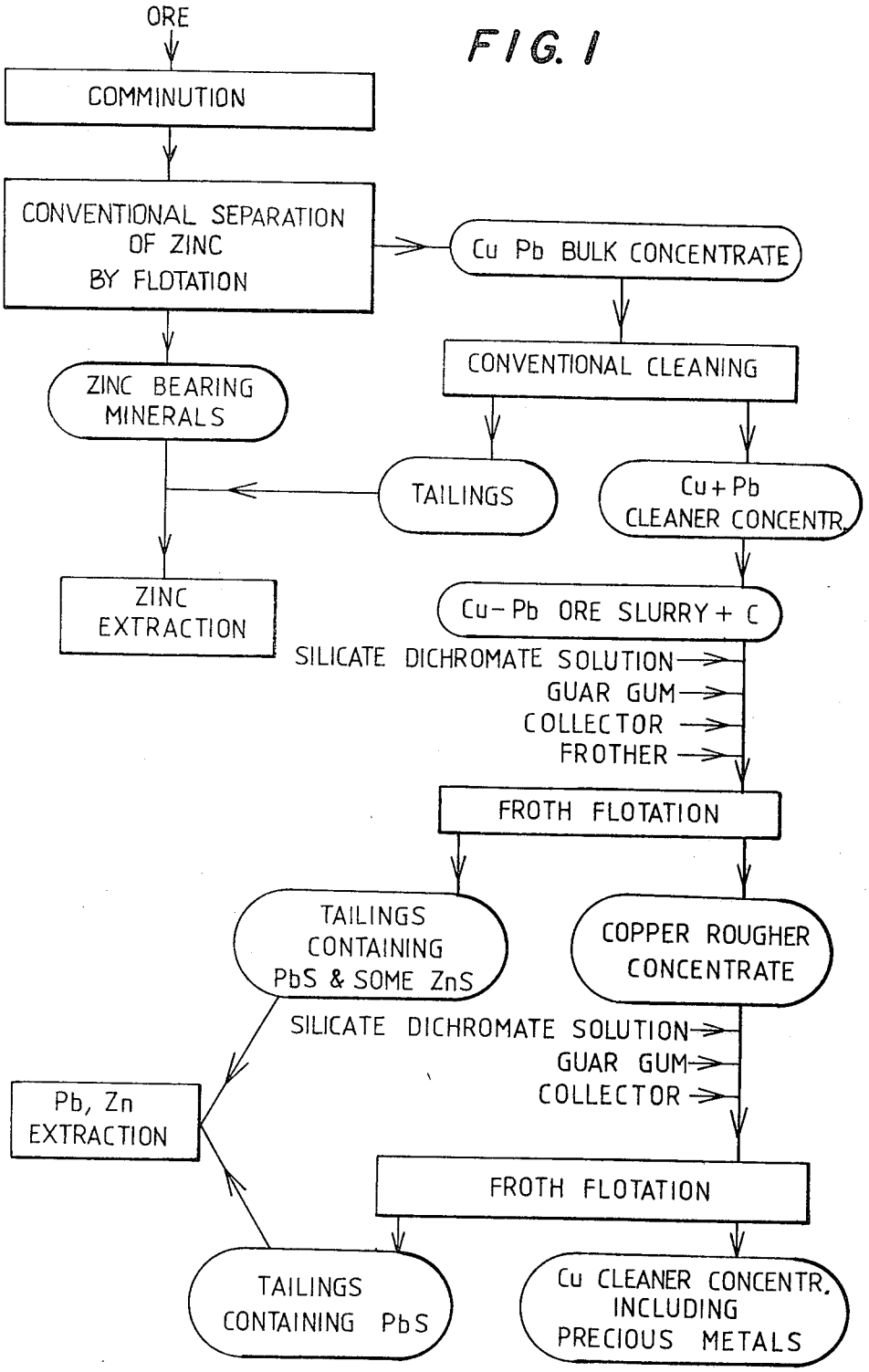

This invention is directed to separating the metal values in complex copper-lead-zinc bearing sulphidic ores by means of flotation processes. These complex ores are usually subjected to a two-stage separation process, producing in the first stage zinc-bearing tailings and a copper-lead bulk concentrate. The second stage aims at separating the copper bearing particles from the lead bearing particles, and it is at this stage that inadequate separation has been encountered in the past. The present invention aims at improving the selectivity in the separation of copper from lead in such copper-lead sulphide concentrates.

Dichromates of alkali metals in the presence of specific conditioners such as sulphur dioxide and lime, or starch, to depress lead-bearing sulphides, have long been used in mineral processing. U.S. Pat. No. 1,142,821, for example, describes a flotation method in which a slurry of a sulphidic ore containing zinc, lead and iron is treated with sodium dichromate, sodium carbonate, eucalyptus oil and kerosene, employing vigorous agitation, to separate the bulk of the zinc, while most of the lead and iron are retained in the tailings. Another example of application of an alkali dichromate solution to depressing lead sulphide bearing minerals, is taught in U.S. Pat. No. 1,375,087, wherein the separation of zinc blende from galena in a concentrate of these sulphides, is effected by froth flotation in the presence of an alkali metal dichromate and a copper-bearing material. There are several methods currently practised in which copper sulphides are separated from lead sulphides by sodium dichromate addition to a slurry of copper-lead minerals, in the presence of sulphur dioxide and lime conditioners. It has been found, however, that the application of a solution of alkali dichromate to depress galena in slurries of complex zinc-lead-copper bearing minerals, either by itself or together with conventional conditioners, brings about insufficient separation of the respective metal values.

The use of sodium silicate as a flocculant in treating clay minerals is well known. In flotation processes aimed at the separation of sulphidic ores, sodium silicate is applied as a dispersing agent. Canadian Pat. No. 866,225, for example, teaches the use of sodium silicate as a conditioner, following the addition of other organic reagents in order to disperse the gangue mineral.

U.S. Pat. No. 1,257,990 teaches the application of mercury in the froth flotation of sulphides, and in one of the examples provided, potassium dichromate and sodium silicate, in a ratio of 2:1, are utilized to enhance the effect of mercury. The main object of this prior art is directed, however, to separating zinc from pyrites and galena, by the application of mercury as a conditioner, and there is no prior art of which applicant is aware that teaches the use of silicate and dichromate together in the separation of copper sulphides from lead bearing minerals. A publication describing the "Dezincing of Lead Concentrate at the Sullivan Concentrator" (Quarterly of the Colorado School of Mines, Vol. 56, No. 3, p. 145—July 1961) by H. J. Chalmers, in fact warns of the disadvantages of using sodium silicate together with sodium dichromate in the separation of lead bearing minerals from zinc sulphides.

An object of the present invention is to provide an improved method for separating copper from lead in complex ores using an aqueous alkali metal dichromate-alkali metal silicate reagent solution.

By one aspect of the present invention there is provided a method for separating copper sulphides from lead sulphides contained in a particulate copper-lead sulphide concentrate which comprises forming an agitated aqueous slurry of the concentrate, adding thereto (a) an aqueous reagent solution comprising an alkali metal silicate and an alkali metal dichromate to thereby depress said lead sulphides and (b) a collector for collecting said copper sulphides, and separating the copper sulphides from the lead sulphides by froth flotation.

In a preferred embodiment wherein the particulate copper lead sulphide concentrate is derived from a complex zinc-copper-lead sulphide ore which is pretreated by flotation to separate at least a substantial portion of the zinc values therein, the agitated slurry of said concentrate is treated with finely divided activated carbon prior to addition of the alkali metal silicate-alkali metal dichromate lead-depressing reagent solution.

The invention will be described in more detail hereinafter with reference to the drawings in which the sole FIG. 1 is a flowsheet of a mineral separation process incorporating a preferred embodiment of the present invention.

As shown in FIG. 1, a complex zinc-copper-lead sulphide ore is comminuted and then subjected to conventional methods for separation of zinc sulphides from other metal sulphides, such as froth flotation with the addition of zinc sulphate. The tailings containing most of the zinc sulphides are fed to a zinc extracting process. The copper-lead bulk concentrate obtained is cleaned, producing a copper-lead cleaner concentrate and a zinc sulphide tailing which is also fed to the zinc extracting process. Finely divided activated carbon is added to the slurry of the copper-lead cleaner concentrate, and agitated to thereby remove any residual prior flotation reagents, followed by the addition of an aqueous solution containing an alkali metal dichromate and alkali metal silicate, preferably in a weight precent ratio which is close to one. Any concentration of alkali metal silicate between 2 and 10 weight percent in solution has produced an improved separation of the copper sulphides present in the particulate copper-lead sulphide concentrate but best results an alkali metal silicate concentration of about 5 weight percent in solution is preferred.

Polysaccharide gums, such as guar gum and other beam gums are conventional lead sulphide depressants, but the addition of guar or other bean gums, by themselves, to copper-lead sulphidic concentrates obtained from copper-lead-zinc complex ores has been largely ineffective. It has now been found, surprisingly, that adding a polysaccharide gum such as guar gum, locust kernel gum, carob bean gum or the like to the slurry of the copper-lead sulphidic concentrate, subsequent to the addition of the dichromate-silicate reagent solution, considerably enhances its depressant action on the lead sulphide bearing particles.

A conventional collector for copper sulphide such as an alkali metal xanthate (i.e. potassium amyl xanthate, sodium isopropyl xanthate and potassium ethyl xanthate (KEX) and the like) is then added together with an organic frother, such as pine oil (terpineol), Dowfroth® (propylene glycol ether), cresylic acid or the like. Although not shown in FIG. 1, zinc sulphate may also be added as a depressant for any sphalerite (ZnS) which may still be present in the slurry. The tailings from the froth flotation include the bulk of the lead sulphide bearing particles, together with most of the zinc bearing compounds, and the copper sulphides are collected in the rougher concentrate. The copper rougher concentrate is normally subjected to a second froth flotation with essentially the same depressant, collector, and frothing agents as used in the rougher circuit, in order to produce a copper cleaner concentrate. Any precious metals initially present in the complex ore usually report in the copper concentrate fraction.

It is pointed out, that while the addition of a xanthate collector and zinc sulphate is preferred, they are by no means essential for the practicing of the invention, as any other copper collector and/or zinc depressant may be used.

The copper cleaner concentrate may be subjected to another, or several more froth flotation cycles using the same reagents in the same sequence as described above, in order to obtain a copper cleaner concentrate, which may then be fed to any conventional pyro- and/or hydrometallurgical process for the production of metallic copper.

The tailings from the various flotation steps can be combined, and the lead and zinc values extracted by conventional methods either together, or separately.

It has been found that the addition of an alkali metal dichromate together with an alkali metal silicate solution, followed by a polysaccharide gum such as guar gum, in the concentrations and sequence described hereinabove, achieve substantially better separation of copper bearing minerals from lead bearing minerals in particulate copper-lead concentrates than heretofore believed possible.

The surprising improvement achieved in the separation of copper-bearing minerals from lead-bearing minerals in particulate copper-lead sulphides obtained from complex copper-lead-zinc ores using the present invention will be better appreciated by those skilled in the art having regard to the following examples which illustrate the present invention in a quantitative fashion.

EXAMPLE 1

A complex copper-lead-zinc sulphidic ore was subjected to froth flotation to float most of the zinc minerals and produce a copper-lead sulphide bulk concentrate. One sample of the copper lead bulk concentrate thus produced was subjected to a conventional flotation treatment. A second sample of the concentrate was treated with a mixture of sodium dichromate ($Na_2Cr_2O_7$) and sodium metasilicate ($Na_2SiO_3$), in a weight ratio of 1:1, forming a 5% aqueous solution, referred to in the Example as reagent B, and subjected to flotation. The copper concentrate obtained in a first flotation, with Reagent B, was subjected to a second treatment with the same reagents, and a copper cleaner concentrate was obtained. The results are shown in Table 1.

TABLE 1

| Test No | Cu-Pb Separation Method | Feed or Product | Wt. % of Ore | Assays, % Cu | Assays, % Pb | Assays, % Zn | Distribution % Cu | Distribution % Pb | Distribution % Zn |
|---|---|---|---|---|---|---|---|---|---|
| 103 | $SO_2$ bubbled into slurry J-703 (guar gum) at 0.2 lb/ton, Heating at 60° C. | Cu-Pb Conc. Feed | 14.26 | 11.44 | 8.07 | 8.76 | 86.0 | 72.0 | 11.4 |
| | | Cu Conc. Prod. | 8.19 | 17.0 | 10.2 | 9.28 | 73.4 | 52.2 | 7.0 |
| | | Cu-Pb Separation Tail. Prod. | 5.42 | 2.93 | 4.26 | 8.37 | 8.4 | 14.5 | 4.1 |
| 99 | Reagent B at 0.5 lb/ton | Cu-Pb Conc. Feed | 20.00 | 8.94 | 7.14 | 10.9 | 91.2 | 82.0 | 19.4 |
| | | Cu Rougher Conc. Prod. | 10.95 | 15.2 | 2.93 | 10.20 | 85.1 | 18.4 | 9.9 |
| | | Cu Cleaner Conc. Prod. | 10.12 | 16.3 | 2.33 | 10.80 | 84.2 | 13.5 | 9.7 |
| | | Cu-Pb Separation Tail. Prod. | 9.05 | 1.33 | 12.25 | 11.76 | 6.1 | 63.6 | 9.5 |

The improved separation of copper from lead by the addition of Reagent B is clearly shown.

EXAMPLE 2

The procedures of Example 1 were repeated on additional samples of the copper-lead concentrate using (a) Reagent B and (b) Reagent B plus guar gum. The copper concentrate obtained was put through a second flotation cycle with the same reagents. The copper concentrate obtained in the latter flotation is called Copper Cleaner Concentrate. The results are tabulated in Table 2.

TABLE 2

| Test No | Cu-Pb Separation Method | Feed or Product | Wt. % of Ore | Assays, % Cu | Assays, % Pb | Assays, % Zn | Distribution % Cu | Distribution % Pb | Distribution % Zn |
|---|---|---|---|---|---|---|---|---|---|
| 101 | Reagent B at 0.5 lb/ton | Cu-Pb Conc. Feed | 20.71 | 8.71 | 6.78 | 9.44 | 92.3 | 82.4 | 17.6 |
| | | Cu Rougher Conc. Prod. | 10.04 | 16.10 | 3.54 | 6.97 | 82.5 | 20.9 | 6.3 |
| | | Cu Cleaner Conc. Prod. | 9.09 | 17.40 | 2.48 | 7.37 | 81.0 | 13.2 | 6.0 |
| | | Cu-Pb Separation Tail. Prod. | 10.67 | 1.79 | 9.82 | 11.78 | 9.8 | 61.5 | 11.3 |
| 91 | Reagent B at 0.5 lb/ton followed by H-31 (Guar Gum) at 0.08 lb/ton | Cu-Pb Conc. Feed | 18.74 | 9.55 | 7.60 | 9.57 | 91.4 | 82.4 | 15.8 |
| | | Cu Rougher Conc. Prod. | 7.56 | 21.28 | 1.72 | 7.10 | 82.1 | 7.5 | 4.7 |
| | | Cu Cleaner Conc. Prod. | 6.64 | 23.20 | 1.15 | 6.97 | 78.6 | 4.4 | 4.1 |

TABLE 2-continued

| Test No | Cu-Pb Separation Method | Feed or Product | Wt. % of Ore | Assays, % Cu | Pb | Zn | Distribution % Cu | Pb | Zn |
|---|---|---|---|---|---|---|---|---|---|
| | | Cu-Pb Separation Tail. Prod. | 11.18 | 1.62 | 11.58 | 11.24 | 9.3 | 74.9 | 11.1 |

Clearly the presence of guar gum in the slurry has a considerable depressant effect on the lead and zinc.

EXAMPLE 3

A copper-lead concentrate, obtained by treating a complex copper-lead-zinc ore as in Example 1, was subjected to a flotation process employing conventional reagents: sulphur dioxide and guar gum. Another sample of the copper-lead concentrate obtained from a similar source was treated by flotation using finely divided activated carbon (Trade Name: Nuchar), Reagent B (as described in Examples 1 and 2) and Guar Gum (H-31). The results are shown in Table 3. The improvement in the copper separation effected by the combination of carbon, sodium dichromate, sodium silicate and guar gum is clearly illustrated. As in Examples 1 and 2, the copper concentrate obtained was subjected to a flotation cleaner step with the same reagents, producing a copper cleaner concentrate.

TABLE 3

| Test No | Cu-Pb Separation Method | Feed or Product | Wt. % of Ore | Assay, % Cu | Pb | Zn | Distribution % Cu | Pb | Zn |
|---|---|---|---|---|---|---|---|---|---|
| 85 | $SO_2$ bubbled into slurry H-31 (Guar Gum) at 0.10 lb/ton Heating at 70° C. | Cu-Pb Conc. Feed | 22.68 | 7.70 | 3.46 | 4.90 | 92.3 | 47.0 | 9.9 |
| | | Cu Rougher Conc. Prod. | — | — | — | — | — | — | — |
| | | Cu Cleaner Conc. Prod. | 11.18 | 9.02 | 2.57 | 7.86 | 53.3 | 17.2 | 7.8 |
| | | Cu-Pb Separation Tail. Prod. | 11.50 | 6.41 | 4.32 | 2.04 | 39.0 | 29.8 | 2.1 |
| 88 | Nuchar at 0.3 lb/ton Reagent B at 0.5 lb/ton H-31 at 0.13 lb/ton | Cu-Pb Conc. Feed | 24.86 | 7.14 | 4.92 | 4.20 | 90.9 | 72.9 | 11.3 |
| | | Cu Rougher Conc. Prod. | 11.00 | 12.05 | 1.13 | 5.60 | 67.9 | 7.4 | 5.6 |
| | | Cu Cleaner Conc. Prod. | 9.25 | 14.00 | 0.96 | 6.34 | 66.4 | 5.3 | 5.3 |
| | | Cu-Pb Separation Tail. Prod. | 13.86 | 3.24 | 7.93 | 4.56 | 23.0 | 65.6 | 5.7 |

EXAMPLE 4

The procedures of Examples 1, 2 and 3 were repeated using differing amounts of the sodium dichromate-sodium silicate mixture per ton of ore. The results are shown in Table 4.

TABLE 4

| Test No. | Cu-Pb Separation Meth | Feed or Product | Wt. % of Ore | Assay, % Cu | Pb | Zn | Distribution % Cu | Pb | Zn |
|---|---|---|---|---|---|---|---|---|---|
| 92 | Nuchar (c) at 0.3 lb/ton Reagent B at 0.5 lb/ton H-31 (Guar Gum) at 0.1 lb/ton | Cu-Pb Conc. Feed | 14.01 | 12.34 | 7.77 | 7.58 | 88.6 | 68.3 | 9.4 |
| | | Cu Rougher Conc. Prod. | 9.16 | 18.47 | 1.60 | 7.67 | 86.7 | 9.2 | 6.2 |
| | | Cu Cleaner Conc. Prod. | 7.74 | 20.5 | 1.14 | 7.58 | 81.3 | 5.5 | 5.2 |
| | | Cu-Pb Separation Tail. Prod. | 4.85 | 0.75 | 19.44 | 7.41 | 1.9 | 59.1 | 3.2 |
| 107 | Nuchar (c) at 0.3 lb/ton Reagent B at 0.3 lb/ton H-31 (Guar-Gum) at 0.08 lb/ton | Cu-Pb Conc. Feed | 16.39 | 11.50 | 8.16 | 9.15 | 91.5 | 78.1 | 13.4 |
| | | Cu Rougher Conc. Prod. | 8.60 | 19.45 | 2.68 | 8.87 | 83.8 | 13.6 | 6.8 |
| | | Cu Cleaner Conc. Prod. | 7.28 | 22.1 | 2.41 | 10.0 | 80.6 | 10.3 | 6.5 |
| | | Combined Cu-Pb Separation Tail. Prod. | 7.79 | 1.78 | 14.09 | 9.46 | 7.7 | 64.5 | 6.6 |

It is shown in Table 4, that the method is not too sensitive to small variations in the amounts of reagents applied, although somewhat higher copper recoveries and slightly less depression of the lead and zinc is achieved at the 0.5 lb/ton level of Reagent B.

I claim:

1. A method for separating copper sulphides from lead sulphides contained in a particulate copper-lead sulphide concentrate derived from a complex copper-lead-zinc sulphide ore from which at least a substantial portion of the zinc has been removed as tailings by froth flotation, which comprises forming an agitated aqueous slurry of the concentrate, adding thereto (a) an aqueous reagent solution comprising an alkali metal silicate and an alkali metal dichromate to thereby depress said lead sulphides and any remaining zinc sulphide and (b) a collector for collecting said copper sulphides, and separating the copper sulphides from the lead sulphides and said remaining zinc sulphides by froth flotation.

2. A method as claimed in claim 1 wherein said copper lead sulphide concentrate slurry is treated with activated carbon prior to addition to said reagent solution.

3. A method as claimed in claim 1, wherein said alkali metal silicate is sodium silicate and said alkali metal dichromate is potassium dichromate.

4. A method as claimed in claim 1 wherein said silicate and said dichromate are present in substantially equal concentrations and the concentration of each is in the range between 2 and 10 percent by weight.

5. A method as claimed in claim 4 wherein the concentration of each of said silicate and dichromate is about 5 percent by weight.

6. A method as claimed in clam 1 including adding a polysaccharide gum to said slurry subsequent to said reagent solution, to thereby further depress said lead sulphides.

7. A method as claimed in claim 6 wherein said polysaccharide gum is a polysaccharide bean gum selected from the group consisting of guar gum, carob bean gum and locust kernel gum.

* * * * *